US006023882A

United States Patent [19]

Heinrich

[11] Patent Number: 6,023,882

[45] Date of Patent: Feb. 15, 2000

[54] CHRISTMAS TREE STAND COVER

[76] Inventor: Richard L. Heinrich, 910 Eagle Ln., Wrightsville, Pa. 17368

[21] Appl. No.: 08/979,356

[22] Filed: Nov. 26, 1997

Related U.S. Application Data

[60] Provisional application No. 60/043,127, Apr. 9, 1997.

[51] Int. Cl.[7] ..... A37G 33/12

[52] U.S. Cl. ..... 47/40.5; D11/130.1

[58] Field of Search ..... 47/40.5, 42, 83; 248/27.8, 121, 125.1, 127, 163.1; D11/130.1

[56] References Cited

U.S. PATENT DOCUMENTS

| | | | |
|---|---|---|---|
| D. 187,542 | 3/1960 | Cosentino | D11/130.1 |
| D. 356,522 | 3/1995 | Schroeder | D11/130.1 |
| 3,784,136 | 1/1974 | Lopez | 47/40.5 |
| 4,034,505 | 7/1977 | Lydall | 47/40.5 |
| 4,061,306 | 12/1977 | Taylor | 47/40.5 |
| 5,593,743 | 1/1997 | Baker | 47/40.5 |

*Primary Examiner*—Michael J. Carone
*Assistant Examiner*—Elizabeth Shaw
*Attorney, Agent, or Firm*—Dallett Hoopes

[57] ABSTRACT

An annular cover for a Christmas tree stand comprising a plurality of arcuate generally rigid segments, each segment having at its opposite ends radial inward flanges. Fasteners hold together the proximate flanges of adjacent segments. In a preferred form, the fasteners comprise male and female halves. The halves interfit to hold adjacent segments together.

3 Claims, 1 Drawing Sheet

CHRISTMAS TREE STAND COVER

REFERENCE TO RELATED APPLICATIONS

This utility application is based on a provisional application No. 60/043,127 filed Apr. 9, 1997 to which date priority for this application is hereby claimed.

FIELD OF THE INVENTION

This invention relates to a cover for a Christmas tree stand. More specifically, this invention relates to an annular cover comprising arcuate segments which may be readily attached together.

BACKGROUND OF THE INVENTION

Traditionally, Christmas trees have been supported by either metal or wooden stands which clamp onto the lower end of the tree trunk and hold the tree in vertical position. Because such stands are either unsightly or distracting in appearance, they have been covered by a cloth drape of some sort, often a white sheet to suggest a snowy location.

Such drapings have easily become displaced, again revealing the stand. They have become tattered and untidy looking.

There is a need for a more secure cover which will stay in place and appear the same for the entire Christmas season. In addition, there is a need for a rigid cover which can reliably form the basis for decorative miniature houses, snow scenes and a miniature railroad track. It is the object of the present invention to fill this need.

SUMMARY OF THE INVENTION

The present invention is an annular cover for a Christmas tree stand comprising a plurality of arcuate, generally rigid segments, each segment having at its opposite ends radial inward flanges. The invention also includes fastening means holding together the proximate flanges of adjacent segments. In a preferred form, the fastening means can comprise couplings, one coupling half on one of the proximate flanges and the other coupling half on the other proximate flange.

The halves of the couplings interfit to hold adjacent segments together.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
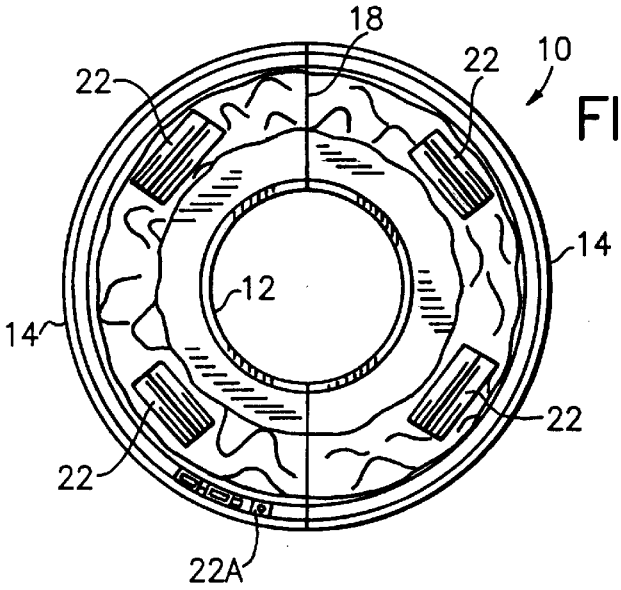
FIG. 1 is a top plan view of an assembled cover embodying the invention.
Figure 2:
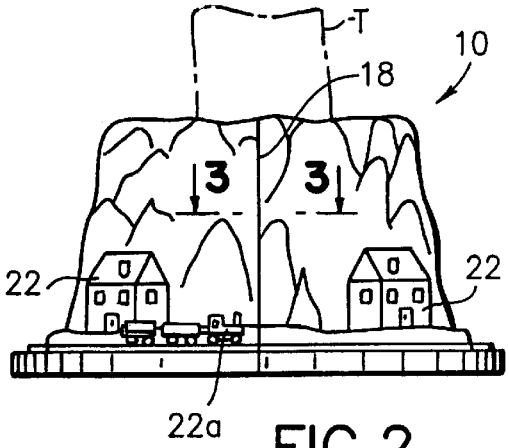
FIG. 2 is a side elevation.

A Christmas tree stand cover embodying the invention is shown in FIG. 1 and generally designated 10. It is annular and frusto-conical, as shown, and is formed with a central tree-trunk-receiving aperture 12. The trunk is not shown. The cover is shaped and contoured on its outside to resemble a miniature mountain.

The cover comprises a plurality of identical arcuate segments 14, each segment having a wall of generally uniform thickness and having an integral inturned flange 16 at each end extending radially of the annular cover.

Figure 3:
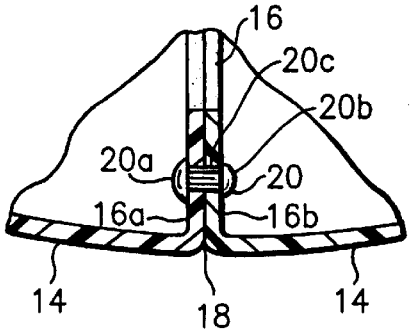
FIG. 3 is an enlarged fragmentary sectional view illustrating how the segments may be joined.
Figure 4:
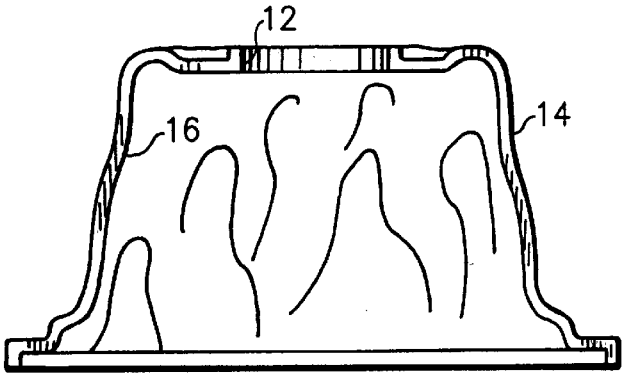
FIG. 4 is a side elevational view of one of the segments taken from inside.

The flanges 16 of adjacent segments 14 are secured together to form a joint 18 by releasable means 20. As shown in FIG. 3, the releasable means 20 may be a snap fastener comprising a stud 20*a* having a head 20*b*. The stud 20*a* may be secured to the flange 16*a* and extend through a perforation therein so that the head 20*b* is spaced from the flange 16*a*. In assembly with the segments surrounding a tree trunk (not shown), the stud 20*a* extends through a socket 20*c* in the flange 16*b*. The stud 20*a* thus becomes a male element of a snap fastener, and the socket 20*c* becomes the female element.

Because the material of the segments and the flanges is somewhat resilient, being molded of polypropylene or other appropriate plastic, the socket 20*c* will yield for the passage of the head 20*b* in snap fastener-like fashion. Thus, once installed, the fastener 20*a*, 20*b*, 20*c* will releasably hold together the flanges 16*a* and 16*b*.

In disassembling the cover, the flanges 16 (FIG. 3) may be pulled apart so that the fastener head 20*b* will pass through the socket 20*c*, again in snap-fastener fashion. The assembly and disassembly procedure may be repeated from year to year.

Figure 3A:
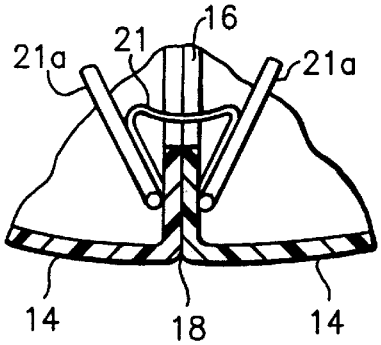
FIG. 3A is similar to FIG. 3 but showing as a fastening means a spring binding clip.

Other fastener arrangements are envisioned. For instance, the flanges 16 of the FIG. 3A may be held together by a conventional stationery binder clip comprising C-shaped spring 21 having pivotable bail-type lever actuators 21*a*. The binder clips may be assembled onto the structure by putting the segments in place around the trunk then raising the cover slightly to reach underneath, squeezing the bails 21*a* together and then maneuvering the clip to close on either side of proximate flanges, clamping them together (FIG. 3A).

The miniature mountain may be ornamented with miniature houses 22 and a train 22*a* the tracks of which may be placed on an annular ledge about the periphery of the cover as shown.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A generally frusto-conical annular cover for a Christmas tree stand comprising a plurality of annularly arranged arcuate, rigid molded substantially imperforate segments externally contoured to represent mountainside topography, each segment having at its opposite ends respectively radial inward flanges, the proximate flanges on adjacent segments being in butting relation, and couplings holding together proximate flanges of respective adjacent segments, one-half of each coupling being on one proximate flange and the other half of each coupling being on the other proximate flange, the halves of each coupling interfitting to hold the proximate flanges together.

2. A cover for a Christmas tree as claimed in claim 1 wherein the segments are molded of polypropylene.

3. A cover for a Christmas tree as claimed in claim 1 wherein the cover includes thereabout an external annular ledge for supporting a miniature train.

* * * * *